US005729855A

United States Patent [19]

Davis

[11] Patent Number: 5,729,855

[45] Date of Patent: Mar. 24, 1998

[54] BOWLING LANE CONDITIONING MACHINE WITH SINGLE HEAD DISPENSER

[75] Inventor: John M Davis, Sebring, Fla.

[73] Assignee: The Kegel Company, Inc., Sebring, Fla.

[21] Appl. No.: 661,366

[22] Filed: Jun. 11, 1996

[51] Int. Cl.[6] ..... A63D 5/10; A47L 11/30

[52] U.S. Cl. ..... 15/50.3; 15/4; 15/98; 15/320; 118/207; 118/244

[58] Field of Search ..... 15/4, 50.1, 50.3, 15/51, 52, 98, 99, 103.5, 320; 118/207, 244, 249, 269

[56] References Cited

U.S. PATENT DOCUMENTS

| | | | |
|---|---|---|---|
| 1,118,870 | 11/1914 | Lane . | |
| 2,622,254 | 12/1952 | Mendelson | 15/52 |
| 2,893,047 | 7/1959 | Swihart | 15/347 |
| 2,978,721 | 4/1961 | Simmons | 15/98 |
| 3,083,390 | 4/1963 | Wroten | 15/103.5 |
| 3,103,087 | 9/1963 | Goff . | |
| 3,150,407 | 9/1964 | Mitchell . | |
| 3,216,036 | 11/1965 | Rockwood et al. | 15/98 |
| 3,216,037 | 11/1965 | Stevens et al. . | |
| 3,273,532 | 9/1966 | Brzuskiewicz et al. . | |
| 3,418,672 | 12/1968 | Regan | 15/98 |
| 3,604,037 | 9/1971 | Varner | 15/4 |
| 3,729,769 | 5/1973 | Sharpless | 15/347 |
| 3,837,028 | 9/1974 | Bridge | 15/50.1 |
| 3,868,738 | 3/1975 | Horst et al. | 15/4 |
| 4,134,361 | 1/1979 | Benjamin . | |
| 4,137,591 | 2/1979 | Baker | 15/98 |
| 4,246,674 | 1/1981 | Ingermann et al. | 15/4 |
| 4,275,884 | 6/1981 | Smith . | |
| 4,369,544 | 1/1983 | Parisi | 15/320 |
| 4,463,469 | 8/1984 | Green | 15/98 |
| 4,510,642 | 4/1985 | Ingermann et al. | 15/231 |
| 4,708,603 | 11/1987 | Kubo . | |
| 4,727,615 | 3/1988 | Kubo | 15/98 |
| 4,738,000 | 4/1988 | Kubo | 15/98 |
| 4,856,138 | 8/1989 | Ingermann et al. | 15/320 |
| 4,920,604 | 5/1990 | Ingermann et al. | 15/302 |
| 4,959,884 | 10/1990 | Ingermann et al. | 15/302 |
| 4,962,565 | 10/1990 | Ingermann et al. | 15/302 |
| 4,980,815 | 12/1990 | Davis . | |
| 5,063,633 | 11/1991 | Ingermann et al. | 15/320 |
| 5,133,280 | 7/1992 | Kubo | 118/259 |
| 5,161,277 | 11/1992 | Ingermann et al. | 15/98 |
| 5,181,290 | 1/1993 | Davis et al. | 15/98 |
| 5,243,728 | 9/1993 | Smith et al. | 15/98 |
| 5,274,871 | 1/1994 | Smith et al. | 15/98 |

*Primary Examiner*—Mark Spisich
*Attorney, Agent, or Firm*—Hovey, Williams, Timmons & Collins

[57] ABSTRACT

A bowling lane maintenance machine includes a shiftable head operable for discharging successive streams of lane dressing during successive passes along the length of an applicator assembly in order to apply lane dressing to a bowling lane according to a predetermined pattern. The preferred embodiment includes a positive displacement pump that delivers successive equal volumes of lane dressing so that the resulting streams are precisely controlled despite variations in the viscosity of the lane dressing.

5 Claims, 5 Drawing Sheets

Microfiche Appendix Included
(3 Microfiche, 151 Pages)

BOWLING LANE CONDITIONING MACHINE WITH SINGLE HEAD DISPENSER

MICROFICHE APPENDIX

A microfiche appendix containing a source code of a computer program useful in accordance with the present invention is appended hereto as 3 sheets of microfiche containing 151 frames.

BACKGROUND OF THE INVENTION

1. Field of the Invention

The present invention relates to the field of bowling lane maintenance and, in particular, to the field of bowling lane maintenance machines operable for applying lane dressing to a bowling lane.

2. Description of the Prior Art

In the prior art, bowling lane maintenance machines have been used for applying lane dressing to a bowling lane. Some prior art machines have used a plurality of side-by-side wicks having the lower end immersed in lane dressing and the upper end shiftable in and out of engagement with a transfer roller. A controller controls the shifting of the wicks so the lane dressing is dispensed in order to achieve a desired lane dressing pattern on the lane.

In some applications, it is desirable to apply lane dressing with greater precision than that allowed by the wick-based machines. For example, the machine disclosed in U.S. Pat. No. 4,980,815, hereby incorporated by reference, discloses the use of four, independently shiftable discharge heads, each with its own metering pump. The machine disclosed in the '815 patent provides extremely precise application of lane dressing previously unattainable in the field of bowling lane maintenance.

As those skilled in the art appreciate, the wick-based machines are more economical to manufacture than the machine represented by the '815 patent, but do not provide the desired degree of repeatability in some applications. Accordingly, the prior art points out the need for a bowling lane maintenance machine that provides the repeatability comparable to that disclosed in the '815 patent but with nearly the economies of manufacture of wick-based machines.

SUMMARY OF THE INVENTION

The bowling lane maintenance machine of the present invention satisfies the prior art needs discussed above and provides a distinct advance in the state of the art. More particularly, the invention hereof enables the economical manufacture of a bowling lane maintenance machine that provides highly precise control of the lane dressing applied to a bowling lane.

The preferred embodiment of the present invention includes a lane dressing assembly having a lane dressing reservoir, a transfer roller for transferring lane dressing to a rotatable brush applicator, and a delivery assembly for delivering lane dressing from the reservoir to the transfer roller. The delivery assembly includes a single delivery head with an outlet nozzle shiftable along the length of the transfer roller, a shifting mechanism for controllable shifting the head, and a volumetric pump for pumping lane dressing from the reservoir to the nozzle. A controller controls the pumping and shifting in order to discharge successive streams of lane dressing onto the transfer roller during successive passes of the head therealong in order to achieve a predetermined pattern of lane dressing on the bowling lane.

In preferred forms, a three-way valve is interposed in the conduit between the pump and the head nozzle. In the recycled position of the valve, lane dressing is recycled to the reservoir and in the delivery position, lane dressing is delivered to the nozzle. An elastomeric tube is interposed in the conduit for minimizing pressure variations in the lane dressing delivered to the nozzle.

DETAILED DESCRIPTION OF THE PREFERRED EMBODIMENT

Figure 7:
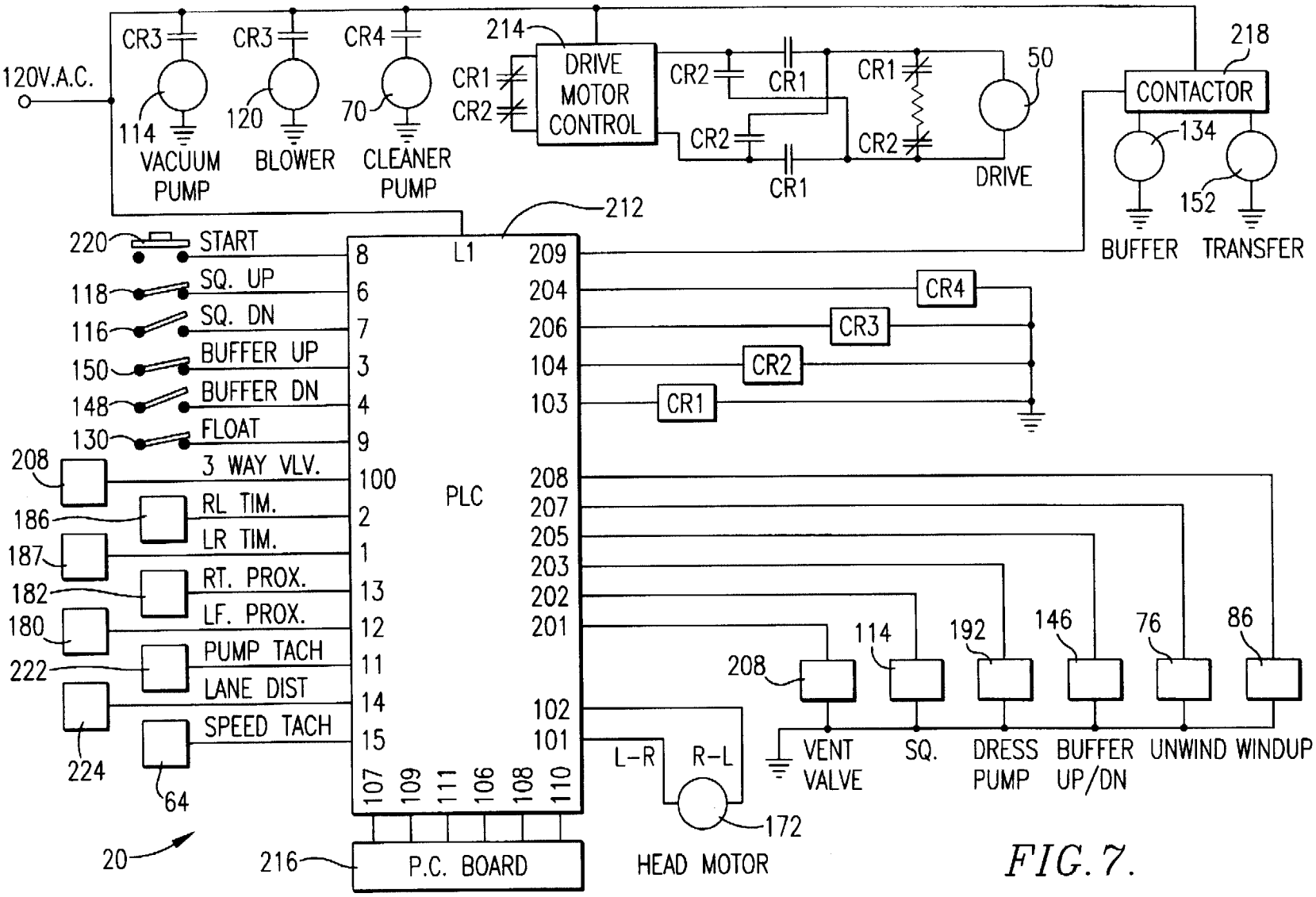
FIG. 7 is a block diagram of the electrical system of the apparatus of FIG. 1.

The drawing figures illustrate the preferred embodiment of bowling lane apparatus 10 constructed in accordance with the present invention. Referring to FIGS. 1–6, apparatus 10 broadly includes housing 12, drive system 14, cleaning assembly 16, lane dressing assembly 18 and control system 20 (FIG. 7).

Figure 1:
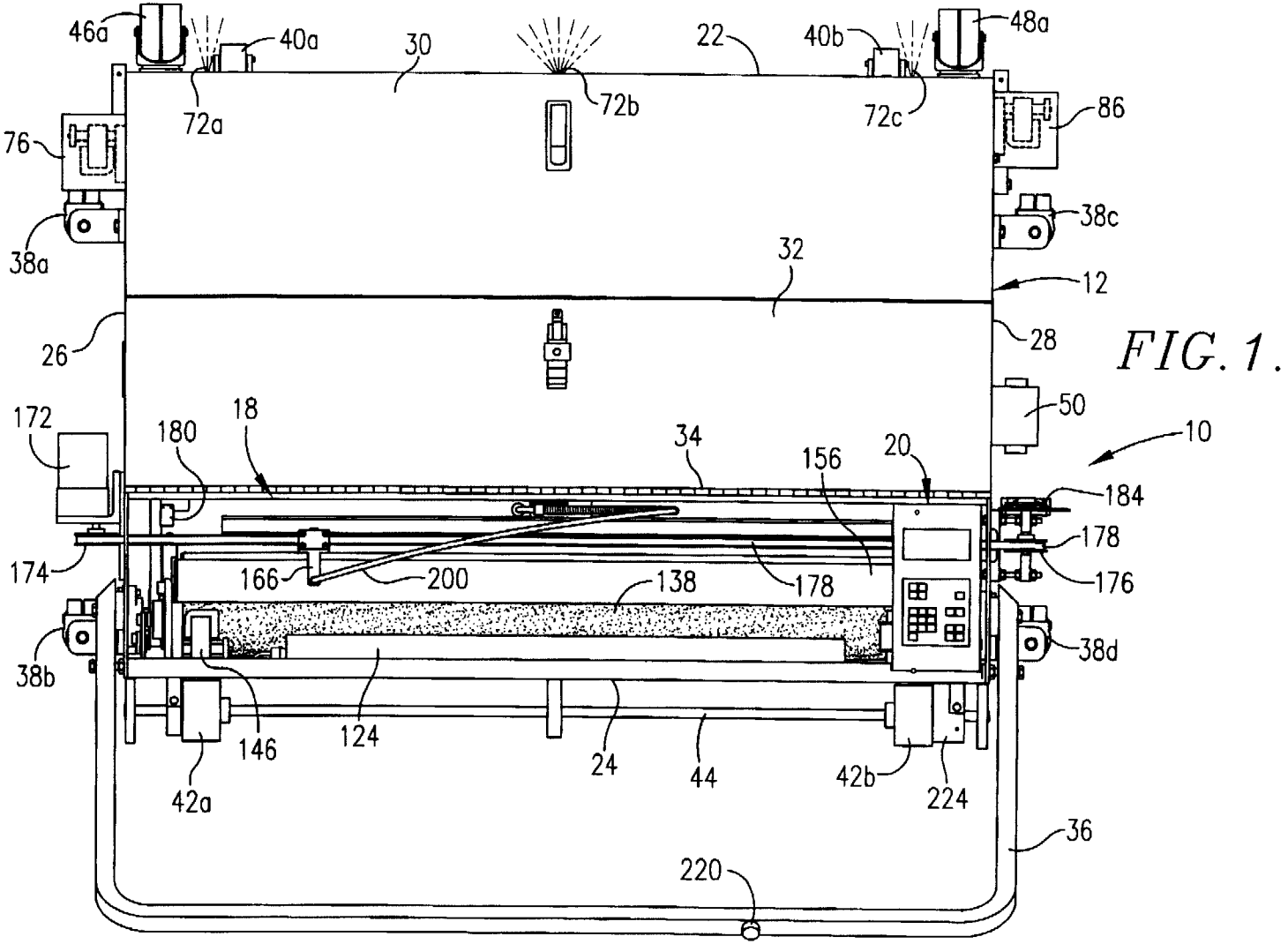
FIG. 1 is a top plan view of the preferred apparatus in accordance with the present invention.
Figure 2:
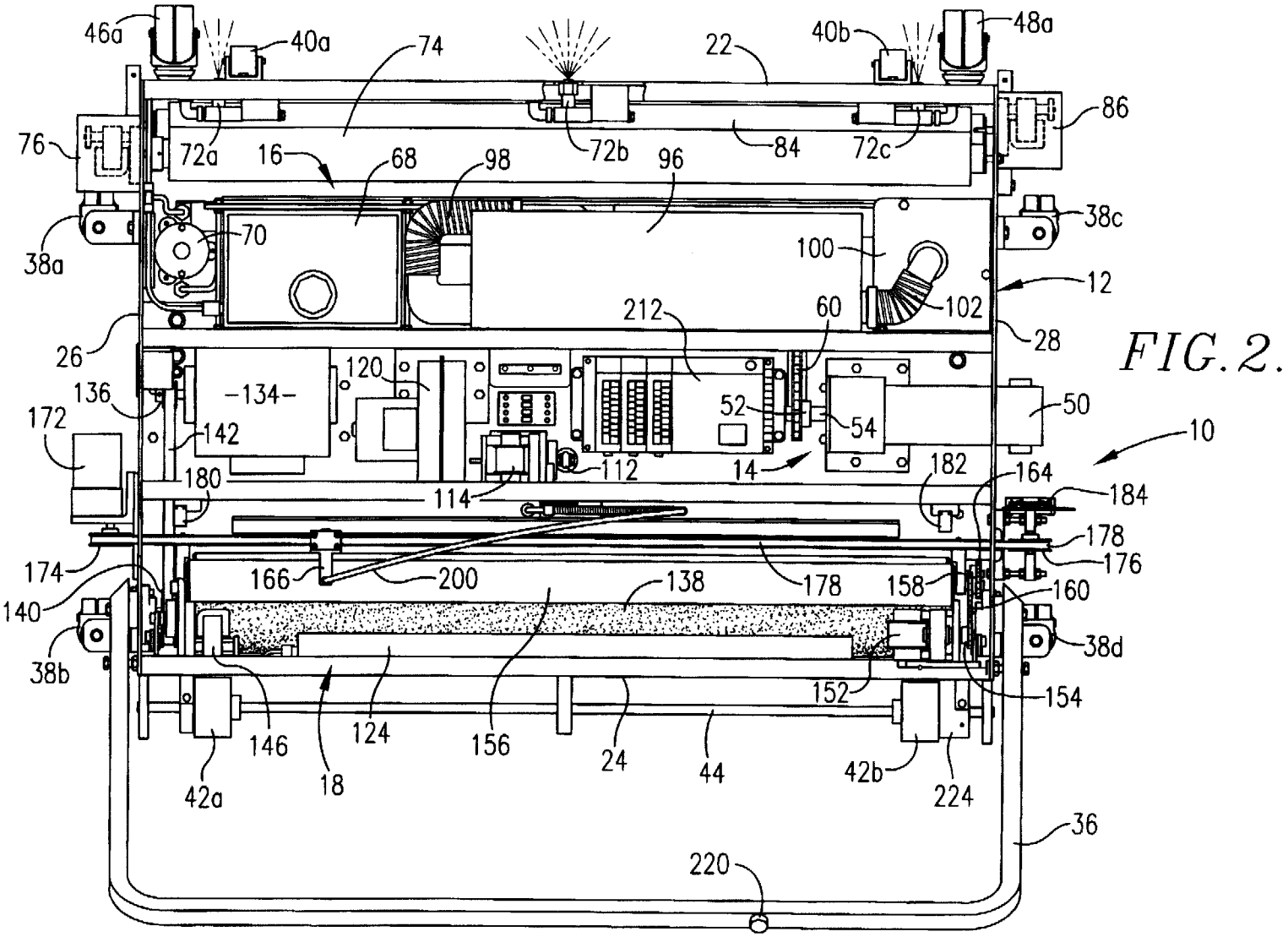
FIG. 2 is a top plan view of the apparatus of FIG. 1 shown with the covers and other components removed for clarity of illustration.
Figure 3:
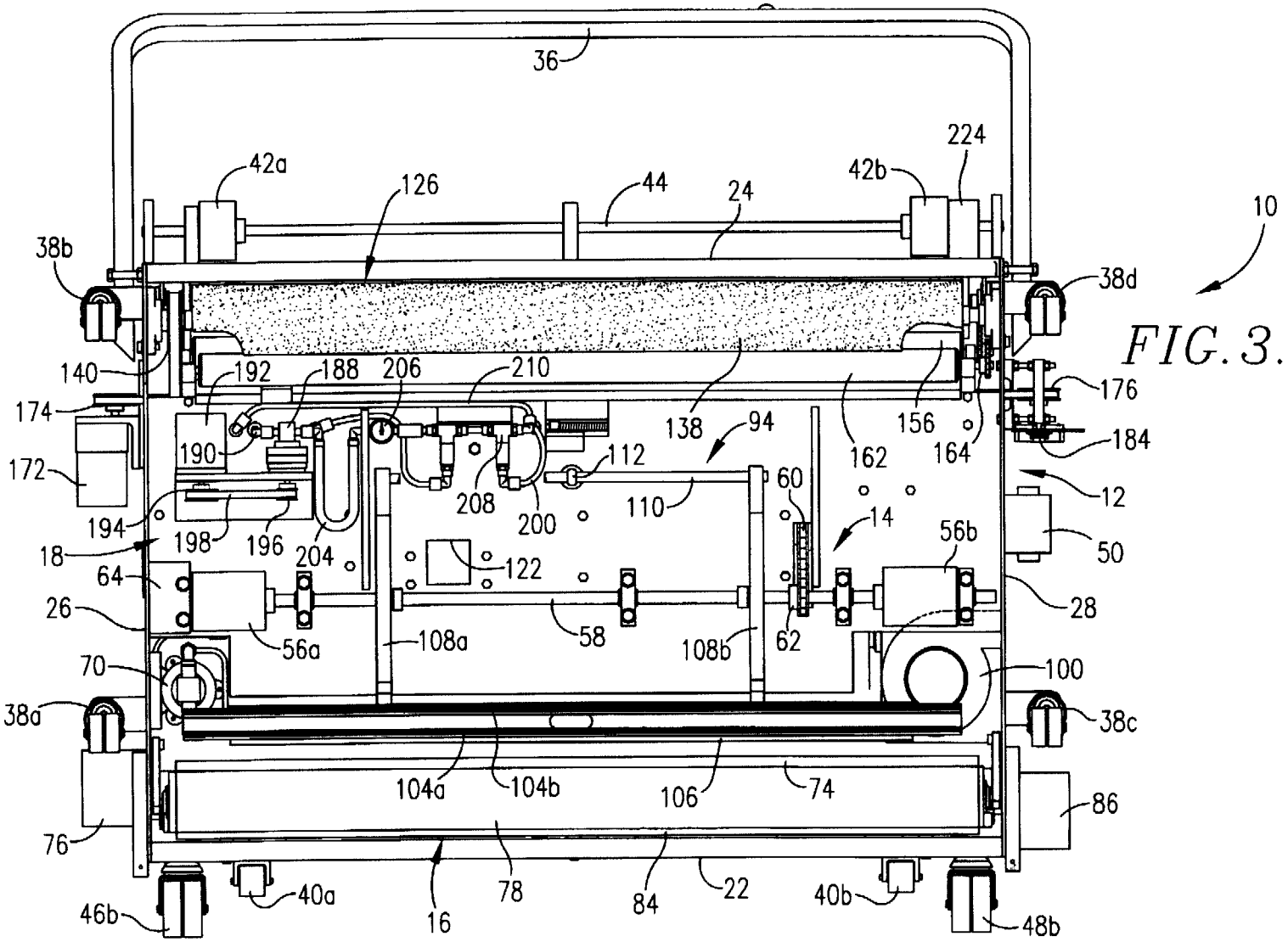
FIG. 3 is a bottom plan view of the apparatus of FIG. 1.
Figure 5:
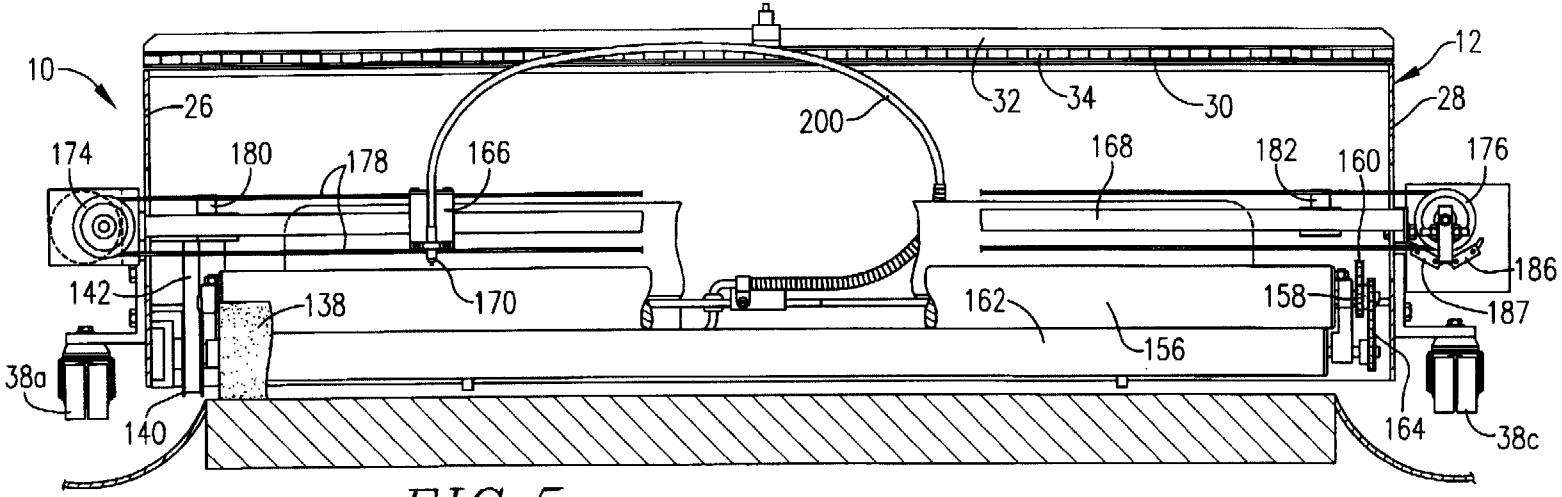
FIG. 5 is a rear elevational view in partial section with portions cut away for clarity of the apparatus of FIG. 1.
Figure 6:
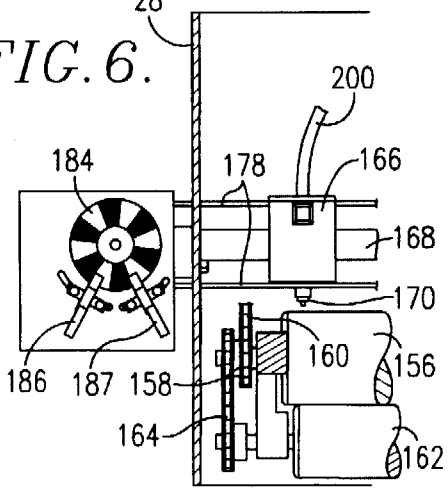
FIG. 6 is a partial sectional view of the head shifting mechanism and transfer roller mechanism of the apparatus of FIG. 1.
Figure 4:
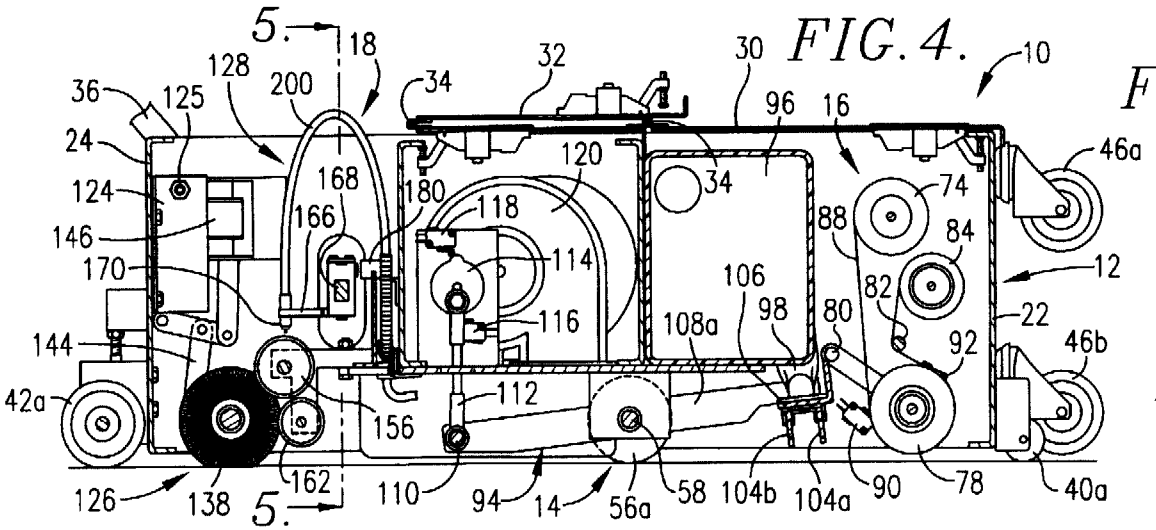
FIG. 4 is a partial, side elevational view in partial section of the apparatus of FIG. 1.

As shown in FIGS. 1–3, housing 12 includes front wall 22, rear wall 24, left side wall 26, right side wall 28, top front door 30 coupled with top rear door 32 by way of piano-type hinge 34, and U-shaped handle 36 having the ends thereof pivotally coupled with side walls 26 and 28 respectively adjacent rear wall 24. Front wall 22 includes four caster wheels **46*a*, 46*b*, 48*a*, and 48*b* mounted at the four corners thereof for rollably supporting apparatus 10 in the storage position. As shown in FIG. 3, front wall 22 also includes two, spaced, front idler approach wheels 40*a*, and 40*b* mounted on the outboard face thereof for rolling support of the front portion of apparatus 10 during transition between the approach area and the bowling lane as shown in FIGS. 1, 4 and 5**.

Rear wall 24 includes two, spaced, rear idler wheels **42*a* and 42*b* mounted on shaft 44 on the outboard face thereof for rolling support of the rear portion of apparatus 10 in the operating position. The inboard sides of left and right side walls 26, 28 include inwardly extending and spring biased, conically shaped, spaced guide wheels (not shown) configured in position to engage the inboard surfaces of the gutters of a bowling lane in order to keep apparatus 10** centered thereon during travel down the lane.

The outboard side of left side wall 26 includes spaced, transition casters **38*a* and 38*b* and the outboard side of right side wall 28 includes spaced, transition casters 38*c* and 38*d*. Casters 38*a–d* are positioned to elevate the lower side of apparatus 10 during movement between lanes while in the operating position. As illustrated in FIG. 5**, these casters are spaced apart greater than the width of lane surface so that they ride in the gutter areas during travel along the lane.

Drive system 14 includes multiple speed, reversible drive motor 50 (Bisson model 011-300-9198, 130 VDC) with drive sprocket 52 mounted on motor shaft 54 (FIG. 2), and includes drive wheels 56*a* and 56*b* mounted to drive shaft 58 as illustrated in FIG. 3. Drive chain 60 interconnects drive sprocket 52 with driven sprocket 62 connected to drive shaft 58. A conventional photoelectric speed tachometer 64 is coupled with the left end of drive shaft 58 with reference to FIG. 3.

Referring to FIGS. 2, 3 and 4, cleaning assembly 16 includes cleaning solution tank 68, cleaning solution pump 70 coupled with tank 68 for receiving cleaning solution therefrom, and spray nozzles 72*a*, 72*b*, and 72*c* fluidly coupled with pump 70 for spraying cleaning solution onto the surface of a bowling lane ahead of front wall 22 as apparatus 10 moves from the foul line toward the pin deck.

Cleaning assembly 16 also includes cloth feed roll 74 with unwind motor 76 attached to the left end thereof (FIG. 2), duster roller 78 pivotally mounted for up and down movement by pivot arms 80, guide shaft 82, and take-up roller 84 with take-up motor 86 attached to the left end thereof (FIG. 2). Cleaning cloth 88 is placed on feed roll 74, extends around duster roller 78 and guide shaft 82 to take-up roller 84. When unwind motor 76 is activated, feed roller 74 rotates and produces slack in cloth 88 (see FIG. 4). This slack allows duster roller 78 to pivot downwardly about pivot arms 80 to engage the bowling lane surface and to operate down limit switch 90. Activation of take-up motor 86 removes the slack in cloth 88 which causes duster roller 78 to pivot upwardly out of contact with the bowling lane surface and to activate up limit switch 92.

Referring to FIGS. 3 and 4, cleaning assembly 16 further includes squeegee mechanism 94, tank 96 for storing spent cleaning solution, hose 98 interconnecting mechanism 94 with tank 96 and vacuum pump 100 interconnected with tank 96 by hose 102. Squeegee mechanism 94 includes spaced, resilient squeegees 104*a* and 104*b*, squeegee holder 106, pivot arms 108*a* and 108*b*, support rod 110, operating arm 112 and squeegee motor 114.

Squeegees 104*a,b* are positioned transversely within apparatus 10 and are long enough to span the width of a bowling lane. Holder 106 supports squeegees 104*a,b* in the spaced relationship illustrated and is coupled with the forward ends of pivot arms 108*a,b*. Support rod 110 engages and supports the opposed ends of pivot arms 108*a,b*. Drive shaft 58 extends centrally through pivot arms 108*a,b* in order to allow these arms to pivot. Operating arm 112 couples squeegee motor 114 with support rod 110 with the opposed end thereof coupled with motor 114 in a conventional offset cam arrangement so that rotation of motor 114 in one direction lifts rod 110 thereby pivoting squeegees 104*a,b* into contact with the bowling lane surface and operating squeegee down switch 116. Continued rotation of motor 114 direction shifts rod 110 downwardly in order to pivot squeegees 104*a,b* upwardly out of contact with the lane surface and to operate squeegee up switch 118.

Cleaning assembly 16 also includes blower 120 which exhausts through opening 122 behind squeegees 104*a,b*. When operated, the exhaust air from blower 120 dries any residual moisture that may remain on the bowling lane surface as a result of the cleaning operation.

Lane dressing assembly 18 (FIGS. 3, 4 and 5) includes lane dressing reservoir 124 (FIG. 4), applicator assembly 126 and lane dressing delivery assembly 128. Reservoir 124 includes float switch 130 (FIG. 7).

Applicator assembly 126 includes buffer drive motor 134 with drive sheave 136 connected to the output shaft thereof, rotatably mounted brush-type buffer 138 with driven sheave 140 connected to the left axle thereof (FIG. 2), and V-belt 142 interconnecting sheaves 136 and 140. Buffer 138 pivots up and down, in and out of contact with the bowling lane surface by way of linkage 144 operated by buffer up/down motor 146. In the down position, buffer 138 operates buffer down limit switch 148 and operates buffer up limit switch 150 in the up position.

Applicator assembly also includes transfer motor 152 with drive sprocket 154 connected to the output shaft thereof, transfer roller 156 rotatably mounted in contact with buffer 138 with driven sprocket 158 connected to the right axle thereof (FIG. 2), and transfer drive chain 160 coupling sprockets 154 and 158. Distribution roller 162 (FIG. 4) is rotatably mounted below transfer roller 126 in contact with buffer 138. Chain 164 interconnects respective sprockets connected to transfer roller 156 and distribution roller 162 so that transfer motor 152 drives both rollers. Buffer 138 and rollers 156, 162 present respective longitudinal axes and span the width of apparatus 10 transverse to the direction of travel and thereby transverse to the bowling lane.

Lane dressing assembly 128 includes a single delivery head 166 slidably mounted on support bar 168 which spans the width of apparatus 10 allowing head 166 to shift longitudinally relative to applicator assembly 126 and in particular, relative to transfer roller 156. Head 166 also includes lane dressing outlet nozzle 170 configured for discharging lane dressing onto applicator assembly 126 and particularly onto transfer roller 156 as head 166 shift therealong.

In order to controllably shift head 166 and nozzle 170, lane dressing assembly 128 includes head motor 172 (Oriental model 3RK15GN-AUL with transmission 3GM5KA) connected to left side wall 26 having drive sheave 174 coupled with the output shaft thereof, driven sheave 176 rollably mounted to right side wall 28, and V-belt 178 interconnecting sheaves 174 and 176. Head 166 is positioned between the upper and lower portions of V-belt 178 and the upper portion is clamped to the top of head 166. In this way, activation of motor 172 and the resulting movement of belt 178 causes head 166 to shift along transfer roller 156. Left and right proximity sensors 180 and 182 sense the respective left and right positions of head 166 at the limits of travel.

Notched timing wheel 184 is mounted to drive sheave 176 in order to rotate therewith. Right-to-left (RL) timing sensor 186 is positioned to sense the rotation of timing wheel 184 in order to sense the position of head 166 between proximity sensors 180 and 182. Similarly, left-to-right (LR) timing sensor 187 is also positioned to sense the rotation of wheel 184 for sensing the position of head 166 during left-to-right movement of head 166.

Delivery assembly 128 further includes positive displacement pump 188 (FIG. 3) (Fluid Metering, Inc. model RHOCKC Lab Pump, Jr.) with the inlet thereof receiving lane dressing from reservoir 124 by way of inlet line 190. Pump 188 is driven by pump motor 192 having drive sheave 194 connected to the output shaft thereof. Driven sheave 196 is coupled with the shaft of pump 188 and cog belt 198 couples sheaves 194 and 196. Conduit 200 fluidically couples the discharge of pump 188 with delivery head nozzle 170. Elastomeric tube 204 presents a U-shaped configuration and is interposed in conduit 200 adjacent the discharge of pump 188 for minimizing variations in the pressure of lane dressing delivered to nozzle 170. Pressure gage 206 is located adjacent the discharge end of tubing 204. A three-way calibration test valve (not shown) is also included in conduit 200 for diverting the flow to a graduate for calibrating pump 188.

Electrically operated three-way valve 208 (General model 91-48-900, 24 VDC) is also interposed in conduit 200 and is shiftable between recycle and delivery positions. In the recycle position, valve 208 recycles lane dressing back to reservoir 124 byway of recycle line 210. In the delivery position, valve 208 delivers the lane dressing from pump 188 to nozzle 170. The provision of pump 188 as a positive displacement pump ensures precise and repeatable delivery of lane dressing to nozzle 170 despite any variations in the viscosity of the lane dressing.

FIG. 7 is a block diagram illustrating the control system 20 of apparatus 10. Control system 20 includes, in addition to the electrical components already mentioned above, controller 212 (programmable logic controller Omron model C 200-HS), drive motor control 214, printed circuit board 216, motor contactor 218 and control relays CR1, CR2, CR3 and CR4. System 20 further includes start switch 220 mounted to handle 36, tachometer 222 for monitoring the RPM of lane dressing pump motor 192, lane distance sensor 224 mounted to shaft 44 adjacent drive wheel **42*b*, and vent valve 225 coupled with lane dressing tank 124. Controller 212 briefly activates vent valve 225 at the beginning of each pass to relieve any vacuum that may have developed in tank 124**.

Control relays CR1 and CR2 control the direction of drive motor 50. Drive motor control 214 in cooperation with board 216 allow the selection of seven different speeds of drive motor 50. In particular, board 216 includes six conventional electrical mechanical relays operated in combination by the six outputs from controller 212. The contacts of the relays of board 216 select manufacturer adjusted resistance values in drive motor control 214 in order to select DC voltage values for the lowest six speeds of drive motor 50. The seventh speed is the highest speed. The six lowest speeds of drive motor 50 are preferably 10, 14, 18, 22, 26 and 30 inches per second. High speed is about 40–50 inches per second with a power supply at 120 VAC and is used for fast return of apparatus 10 from the pin deck to the foul line. If 240 VAC supply is available, high speed can be up to 60 inches per second. Controller 212 supplies voltage at −24 VDC to switches 220, 118, 116, 150, 148 and 130. Power at +24 and −24 VDC are supplied to sensors 186, 187, 182, 180, 222, 224 and 64.

Operation

The operation of apparatus 10 is controlled by way of the program operating controller 212 shown on the microfiche appendix and included as part of the disclosure hereof. Initially apparatus 10 is placed on a bowling lane just forward of the foul line. The operator presses start switch 220 which initiates the sequence of maintenance operation. As will be appreciated, the operation can include cleaning, application of lane dressing, or both as a matter of operator choice. In addition, a variety of lane dressing patterns can also be selected by way of the key pad and display (not shown) as is conventional. For the operating example herein, both cleaning and lane dressing application are explained.

In order to initiate the cleaning operation, controller 212 activates control relay CR3 which in turn energizes vacuum motor 114 and blower 120. In addition, controller activates squeegee motor 114 to lower, and activates unwind motor 76. Controller 212 confirms operation of these components by way of squeegee down switch 116 and duster roller down switch 90.

To initiate the application of lane dressing, controller 212 energizes lane dressing pump 188 and three-way valve 208 to the recycle position whereupon lane dressing is recirculated. Controller 212 also activates motor contactor 218 which energizes buffer drive motor 134 and transfer motor 152. At the same time, controller 212 energizes buffer up/down motor 146 in the down direction so that buffer 138 engages the bowling lane. This is confirmed by buffer down limit switch 148.

When these operations have been initiated, the operator again presses start button 220. In response, controller 212 activates relay CR4 which, in turn, energizes cleaner pump motor 170. Additionally, controller 212 energizes head motor 172 to shift head 166 to the right until it passes right proximity sensor 182. Controller 212 then reverses the direction of head motor 172 so that head 166 moves to the left until it again passes right proximity sensor 182. This is the home position of head 166 and allows controller 212 to zero right-to-left sensor 186 so that the location of head 166 is known during shifting between right and left sensors 180 and 182. This home position corresponds to bowling lane board number 2 on the right and the position of left proximity sensor 180 corresponds to board number 2 on the left. In the preferred embodiment, the positions of head 166 are expressed in the terms of bowling lane board numbers. It will be appreciated that these positions can be expressed in other units.

Next, controller 212 activates PC board 216 and drive motor 214 in order to energize drive motor 50 at one of the preset speeds corresponding to the specified lane dressing pattern. Also in accordance with this pattern, controller 212 switches three-way valve 208 between delivery and recycle positions. As will be appreciated, patterns with greater amounts of lane dressing require slower speeds and positioning of valve 208 in the delivery position more often. When drive motor 50 is energized, apparatus 10 is propelled forward from the foul line toward the pin deck.

In the delivery position of valve 208, and with head 166 shifting along transfer roller 156, a precisely controlled stream of lane dressing is discharged onto roller 156 between the selected locations thereon corresponding to the lane boards. With each of pass of head 166 along the length of roller 156, valve 208 can be shifted to the delivery position at a desired board location to begin a stream of oil and then returned to the recycle position in order to stop the stream of oil. In this way, the shifting of head 166 and the activation of valve 208 are controlled by controller 212 in order to deliver a succession of continuous streams of lane dressing between selected board locations during successive passes of head 166 and thereby nozzle 170 in order to apply lane dressing in accordance with the predetermined pattern stored in the programming of controller 212.

For example, a pattern may call for two successive streams of lane dressing between the left and right lane number 2 boards and then two successive streams between the number 5 left board and the number 10 right board. For this pattern, valve 208 shifts to the delivery position at right board number 2 (home position) and remains until nozzle 170 reaches left board number 2 as determined by RL sensor 186. Valve 208 then shifts to the recycle position until head 166 reverses direction.

On the return pass from left to right, valve 208 shifts to the delivery position at left board number 2 and delivers the stream of oil to transfer roller 156 until it reaches right board number 2 as determined by LR sensor 187. On the third pass, valve 208 delivers a stream of lane dressing between right number 10 board and left number 5 board and on the fourth from left to right delivers a stream between left number 5 board and right number 10 board. In the preferred embodiment, head 166 travels the length of transfer roller 156 in about 1.5 seconds.

Transfer roller 156 is rotating in engagement with rotating buffer 138. A stream of oil received by roller 156 is received by buffer 138 and delivered to the bowling lane. Distribution roller 172 also rotating in engagement with buffer 138 cooperates with transfer roller 156 in order to distribute the lane dressing about the periphery of buffer 138 for achieving a uniform lane dressing pattern longitudinally along the lane.

At a programmed distance along the length of the lane as determined by lane distance sensor 224, controller 212 energizes buffer up/down motor 146 to raise buffer 138 in contact with the lane as indicated by buffer up limit switch 150. Apparatus 10 continues to the pin deck while continuing the cleaning operation. When the application of lane dressing is discontinued, controller 212 may increase the speed of drive motor 50 in accordance with the operating mode selected because the cleaning operation conducted more quickly than the application of lane dressing.

Upon reaching the pin deck, controller 212 de-energizes vacuum motor 114, blower 120 and cleaner pump 70 and raises duster roller 78 by energizing wind up motor 176. At this time, controller 212 de-energizes drive motor 150 and reverses the direction of drive motor 50 at high speed in order to return apparatus 10 to the foul line quickly. Apparatus 10 is then moved to the next lane for maintenance.

Having thus described the preferred embodiment of the present invention, the following is claimed as new and desired to be secured by Letters Patent:

1. A bowling lane maintenance apparatus comprising:

dressing means operable for applying lane dressing to a bowling lane as said apparatus is propelled therealong;

drive means operable for propelling said apparatus along the bowling lane; and control means for controlling the operation of said dressing and drive means, said dressing means including a lane dressing reservoir, applicator means operable for receiving lane dressing and for applying lane dressing so received to the bowling lane as said apparatus is propelled therealong, said applicator means presenting a longitudinal axis extending transversely relative to the direction of movement of said apparatus and thereby transversely to the bowling lane, and delivery means for delivering lane dressing from said reservoir to said applicator means including a single delivery head longitudinally shiftable relative to said applicator means and having structure defining a nozzle configured for discharging lane dressing onto said applicator means as said head shifts therealong, shifting means for controllably shifting said head and nozzle along substantially the entire length of said applicator means, and pump means for controllably pumping lane dressing from said reservoir to said nozzle, said control means including means for controlling said shifting means and pumping means in order to coordinate said shifting and pumping thereof for delivering lane dressing to locations on said applicator means, and thereby to the bowling lane, in accordance with a predetermined pattern.

2. The apparatus as set forth in claim 1, said control means including means for controlling said shifting and pumping means for delivering a succession of continuous streams of lane dressing between selected locations on said applicator means during successive passes of said nozzle along said applicator means in order to apply lane dressing in accordance with said predetermined pattern.

3. The apparatus as set forth in claim 2, said pumping means including a pump coupled with said reservoir for receiving lane dressing and having a discharge for discharging lane dressing therefrom, a conduit interconnecting said discharge and said nozzle, and a valve interposed in said conduit shiftable between a recyclable position in which lane dressing discharged from said pump is recycled to said reservoir through a recycle line and a delivery position in which lane dressing discharged from said pump is delivered to said nozzle, said pump being a volumetric pump operable for discharging lane dressing at a constant volumetric rate despite variations in the viscosity of the lane dressing.

4. The apparatus as set forth in claim 3, said pump being a positive displacement pump operable for discharging successive volumes of lane dressing, said pumping means further including an elastomeric tube interposed in said conduit and configured for minimizing pressure variations in the lane dressing delivered to said nozzle.

5. The apparatus as set forth in claim 1, said locations on said applicator means corresponding to lane boards on the bowling lane.

* * * * *